US012222181B1

(12) United States Patent
Lavin

(10) Patent No.: US 12,222,181 B1
(45) Date of Patent: Feb. 11, 2025

(54) READY-TO-LOAD AMMUNITION CONTAINER

(71) Applicant: Wyatt Lavin, Lake Worth, FL (US)

(72) Inventor: Wyatt Lavin, Lake Worth, FL (US)

( * ) Notice: Subject to any disclaimer, the term of this patent is extended or adjusted under 35 U.S.C. 154(b) by 0 days.

(21) Appl. No.: 18/602,780

(22) Filed: Mar. 12, 2024

(51) Int. Cl.
*F41A 9/83* (2006.01)

(52) U.S. Cl.
CPC ..... *F41A 9/83* (2013.01)

(58) Field of Classification Search
CPC ..... F41A 9/83
See application file for complete search history.

(56) References Cited

U.S. PATENT DOCUMENTS

| | | | | |
|---|---|---|---|---|
| 9,772,152 | B1 * | 9/2017 | Niccum | F41A 9/83 |
| 10,274,275 | B1 * | 4/2019 | Terrell | F41A 9/83 |
| 2020/0064093 | A1 * | 2/2020 | Wilkinson | F41A 9/83 |

* cited by examiner

*Primary Examiner* — J. Woodrow Eldred
(74) *Attorney, Agent, or Firm* — The Rapacke Law Group, P.A.; Andrew Rapacke

(57) ABSTRACT

A ready-to-load ammunition container is disclosed, including a housing comprising a first sidewall, a second sidewall, a top, and a bottom each defining an interior of the housing. The interior retains a plurality of rounds of ammunition. A first wing is integrally molded to the first sidewall and a second wing is integrally molded to the second sidewall. The first wing and the second wing are each positioned at a bottom portion of the housing to define an opening to allow the plurality of rounds to pass therethrough. The first wing and the second wing are configured to releasably engage with a magazine of a firearm during the reloading process. A push bar is connected to a sliding member to forcibly push the plurality of rounds through the opening.

18 Claims, 2 Drawing Sheets

READY-TO-LOAD AMMUNITION CONTAINER

TECHNICAL FIELD

The embodiments disclosed herein generally relate to ammunition containers, and more specifically to ready-to-load ammunition containers which assist in the rapid loading of ammunition into a firearm magazine.

BACKGROUND

Firearms are designed to hold ammunition prior to being fired. Many firearms are capable of holding multiple rounds of ammunition which must be reloaded into a magazine once all the ammunition has been fired. This process can be tedious and time consuming.

To efficiently and easily reload firearms, speedloaders have been developed. Speedloaders come in various configurations depending on the type of firearm they are designed to reload. For example, speedloaders have been developed for reloading revolvers, as well as magazines used with handguns, rifles, and shotguns.

In particular, loading a firearm magazine can be especially tedious. Firearm magazines which carry a large capacity and corresponding high spring pressure to force the rounds to the top of the magazine can be difficult to reload efficiently. Simple devices have been created which depress the top round within the magazine to allow the subsequent round to be easily inserted into the top of the magazine. Other speedloader configurations hold a number of rounds which can be inserted into the magazine. In some cases, especially military applications, these devices (commonly known as "stripper clips") can be provided by the manufacture. However, most people purchase ammunition from the manufacture by the box or case wherein the ammunition is packaged in bulk. This can be time-consuming for the user to organize and does not provide a reliable means of estimating the number of rounds remaining in the box over time.

SUMMARY OF THE INVENTION

This summary is provided to introduce a variety of concepts in a simplified form that is further disclosed in the detailed description of the embodiments. This summary is not intended for determining the scope of the claimed subject matter.

The embodiments provided herein relate to a ready-to-load ammunition container, including a housing comprising a first sidewall, a second sidewall, a top, and a bottom each defining an interior of the housing. The interior retains a plurality of rounds of ammunition. A first wing is integrally molded to the first sidewall and a second wing is integrally molded to the second sidewall. The first wing and the second wing are each positioned at a bottom portion of the housing to define an opening to allow the plurality of rounds to pass therethrough. The first wing and the second wing are configured to releasably engage with a magazine of a firearm during the reloading process. A push bar is connected to a sliding member to forcibly push the plurality of rounds through the opening.

The ready-to-load ammunition container provides an efficient and easy means of quickly reloading the magazine of a firearm. The container greatly reduces the time needed to reload the magazine, while reducing the tentative aspects of loading rounds into the magazine individually.

The ready-to-load ammunition container may be sold pre-loaded with rounds of ammunition, thus eliminating the utility of a speedloader. Further, the container being sold with ammunition pre-loaded therein eliminates the need to load a speedloader which can be a tedious process in itself.

The ready-to-load ammunition container can be sold having traditional labeling on the housing, including the caliber, round count, material type, and other packaging and labelling commonly included on ammunition boxes.

The ready-to-load ammunition container may be configured to utilize nearly any caliber of ammunition and may be configured to be used with various magazine configurations.

In one aspect, the bottom is removably connected to the first wing and the second wing.

In one aspect, the bottom includes a pull tab to allow the user to easily grip and remove the bottom from the housing.

In one aspect, the first sidewall and the second sidewall include one or more structural elements to provide rigidity to the housing.

In one aspect, the push bar includes a first tab and a second tab. The first tab is positioned on a left side and the second tab is positioned on a right side, wherein each of the first tab and the second tab increase grip when sliding the push bar downwards.

In one aspect, a clip is provided to selectively retain the push bar at a top portion of the housing.

In one aspect, a front of the housing includes a first face and a second face, wherein the first face and the second face at least partially cover the front of the housing.

In one aspect, the first wing and the second wing form a friction fit with a top of the magazine.

In one aspect, the housing is constructed of single-use disposable materials. Alternatively, the housing is constructed to be re-used by reloading the housing with an amount of ammunition.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
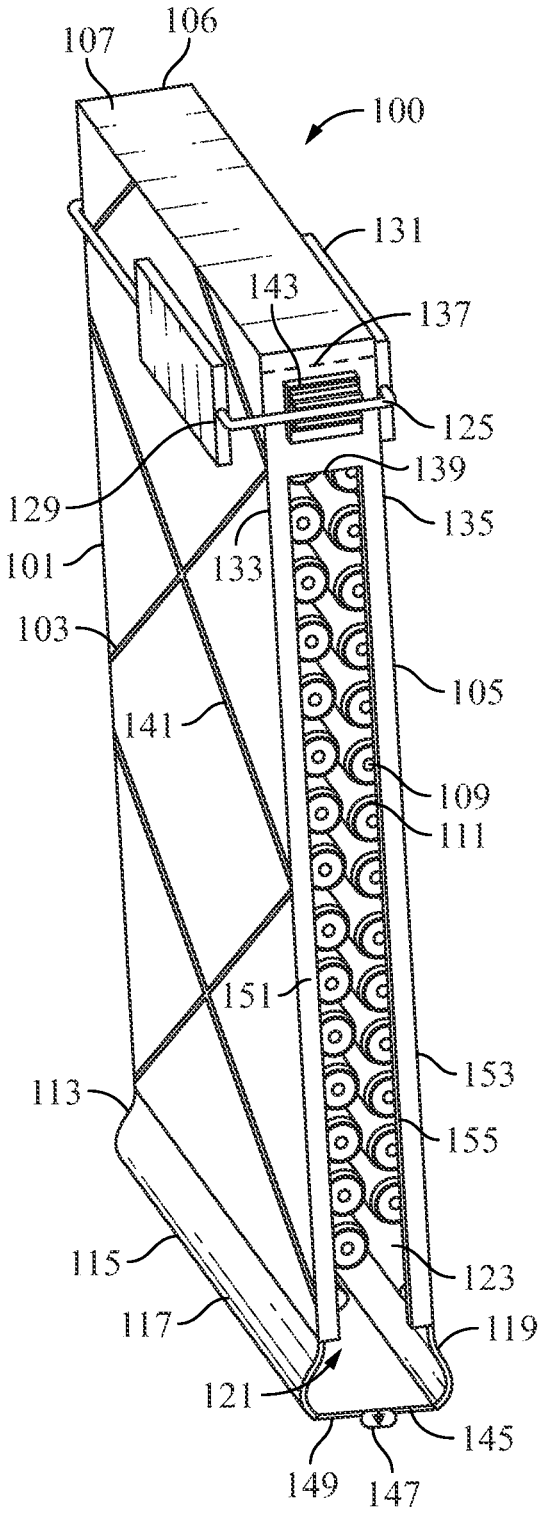
FIG. 1 illustrates a perspective view of the ready-to-load ammunition container, according to some embodiments.

The specific details of the single embodiment or variety of embodiments described herein are set forth in this application. Any specific details of the embodiments described herein are used for demonstration purposes only, and no unnecessary limitation(s) or inference(s) are to be understood or imputed therefrom.

Before describing in detail exemplary embodiments, it is noted that the embodiments reside primarily in combinations of components related to particular devices and systems. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided herein relate to a ready-to-load ammunition container (which may be referred to herein as "the container") which can be used to efficiently and easily reload the magazine of a firearm. The ready-to-load ammunition container can be provided within a box of ammunition. While the exterior of the box of ammunition may appear similar to commonly sold ammunition boxes, the box of ammunition contains the loading mechanism described herein which efficiently and forcibly loads the ammunition into the magazine of the firearm.

During use, the user will open the box of ammunition using a pull-tab or other opening mechanism. The box of ammunition may simply be sealed as is common in the current arts. The user may then position the ready-to-load ammunition container such that the bottom portion is contacting the top of the magazine. A push bar allows the user to forcibly push the ammunition contained within the read-to-load ammunition container into the magazine.

In some embodiments, the ready-to-load ammunition container is constructed of single-use disposable materials, such that the user may simply dispose of the housing of the ready-to-load ammunition container once the ammunition contained therein has been loaded into the magazine. Materials used to construct the ready-to-load ammunition container may be constructed of recyclable materials, compostable materials, or similar materials known in the arts.

In some embodiments, the ready-to-load ammunition container is re-usable. In such, the ready-to-load ammunition container is constructed of materials sufficient to be re-used repeatedly. In such, the user may reload the ready-to-load ammunition container with rounds of ammunition repeatedly as needed. This may be especially useful if the user purchases bulk ammunition which is often loosely packaged by the manufacture. This embodiment removes the need for the user to purchase speedloaders.

The ready-to-load ammunition container can be constructed to accept various calibers of ammunition. Further, the ready-to-load ammunition container can be configured to accept various numbers of rounds of ammunition such that various magazine sizes may be reloaded. Firearm magazines are designed to hold various amounts of ammunition. These magazines may also be stacked in different configurations (e.g., single-stack, double-stack, etc.). The present embodiments provide a ready-to-load ammunition container which can reload magazines having various capacities and configurations.

In some embodiments, the size and configuration of the ready-to-load ammunition container may be modified to accept various calibers of ammunition and amounts thereof without deterring from the inventive aspects described herein.

FIG. 1 illustrates the ready-to-load ammunition container 100. The container 100 may be provided within a disposable box (not shown) to provide the ability for printing branding and information associated with the contents of the container 100 (e.g., ammunition caliber, number of rounds, materials, etc.). The container 100 is comprised of a housing 101 having a first sidewall 103, a second sidewall 105, a back 106 and a top 107. Rounds 109 of ammunition 111 is disposed between the first sidewall 103, the second sidewall 105 and the top 107 such that the rounds 109 are protected from damage during shipping and storage. The housing 101 also protects the rounds 109 from the elements (e.g., sun exposure, dust, moisture, etc.) which may degrade the rounds 109, or contaminate the rounds causing a jam or misfire of the firearm. A bottom portion 113 of the housing 101 includes a receiver 115 including a first wing 117 and a second wing 119 which accept the top of a magazine. The receiver 115 defines an opening 121 allowing for round 109 to pass through when loading the magazine. Further, the opening 121 may allow for rounds 109 to be reloaded into the interior 123 of the housing 101.

To reload a magazine, a push bar 125 is attached to the housing 101. The push bar 125 includes a first tab 129 and a second tab 131 positioned on the left side 133 and right side 135 respectively of the housing. The first tab 129 and second tab 131 allow for the user to easily slide the push bar 125 downwards during the process of reloading the magazine. The push bar 125 is connected to a sliding member 137 provided at the top portion 139 of the interior 123 of the housing 101. The sliding member 137 contacts the rounds 109 to forcibly push the rounds downwards and into the magazine of the firearm.

The housing 101 includes structural elements 141 provided on each of the first sidewall 103 and second sidewall 105. The structural elements 141 provide rigidity to the housing 101 to prevent the housing 101 from bending, breaking, or otherwise being deformed during the reloading process. In such, the structural elements 141 are constructed of a rigid material to reinforce the housing 101.

In some embodiments, the push bar 125 is retained at the top portion 139 of the housing 101 via a clip 143. The clip 143 may form a friction fit with the push bar 125 such that the push bar 125 can be easily disengaged from the clip 143 before the push bar 125 is moved downwards during the reloading process.

The housing 101 may also include a left face 151 and a right face 153 extending at least partially towards the center of the front 155 of the housing 101. The left and right faces 151,153 may not fully enclose the front 155 of the housing 101 to provide a means of viewing the rounds 109 stored within the housing 101. The left and right faces 151,153 provide barrier to contain the rounds 109 within the housing 101.

Figure 2:
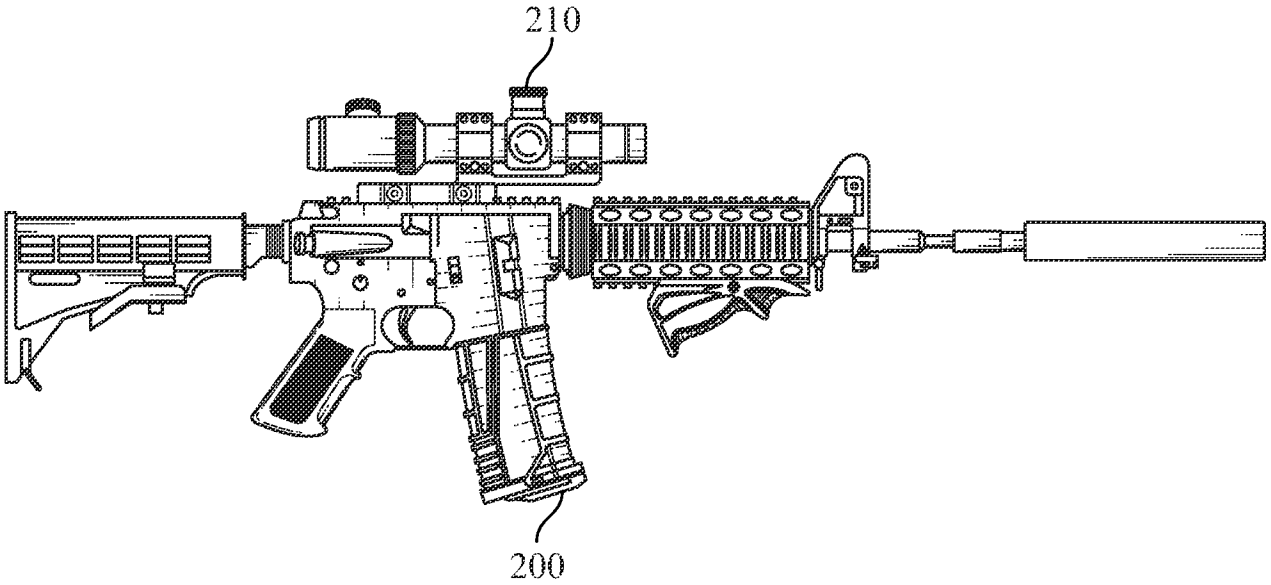
FIG. 2 illustrates a perspective view of the ready-to-load ammunition container reloading the magazine of a firearm, according to some embodiments.
Figure 2:
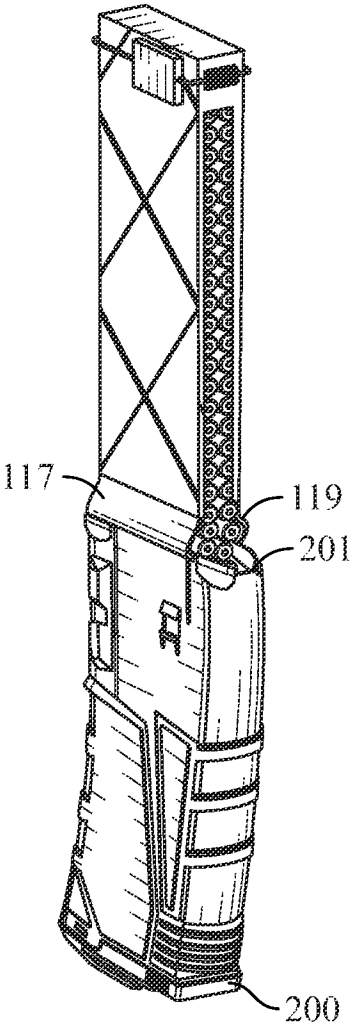

FIG. 2 illustrates the ready-to-load ammunition container being used to reload a magazine 200 of a firearm 210. The wings 117,119 are designed to releasably engage with the upper portion 201 of the magazine 200 to form a secure fit while reloading the magazine 200. Once the magazine 200 is reloaded, the user disconnects the container 100 from the magazine 200.

In some embodiments, rounds 109 may be reloaded into the interior 123 of the housing 101 from the top 107. In this embodiments, the top 107 may be opened, such as by removing the top 107. The top 107 may be fully removed from the housing 101 or may be hingedly attached to the housing 101 using a hinge mechanism.

In some embodiments, the first tab 129 and the second tab 131 may include a coating which provides increased friction and grip when forcibly pushing the push bar 125 downwards. The first tab 129 and the second tab 131 may include a material covering their surface, such as rubber, which provides increased friction and improved grip during reloading. In another example, the first tab 129 and the second tab 131 may include a textured surface which may provide increased friction and improved grip during reloading.

In some embodiments, the container 100 is includes a bottom 145 which is removably connected to the first wing 117, second wing 119 and back 106 of the housing 101. The bottom 145 includes a pull tab 147 allowing the user to remove the bottom 145 from the housing to provide an opening 121 for the rounds 109 to pass through.

In some embodiments, the bottom 145 may slidingly engage with the wings 117,119 via channels which accept the sides of the bottom 145 component. In such, the user may remove and replace the bottom 145 as needed, which may be especially useful in an embodiment wherein the container 100 is reusable. In such, the channels extend along the lengths of each wing 117,119 to accept the length of the bottom 145.

In some embodiments, the push bar 125 is connected to a spring (not shown) disposed within the interior 123 of the housing 101. The spring provides biased tension to the push bar 125 and aids in the reloading process.

In some embodiments, the first wing 117 is integrally molded to the bottom portion 113 of the first sidewall 103 and the second wing 119 is integrally molded to the bottom portion 113 of the second sidewall 105.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety to the extent allowed by applicable law and regulations. The systems and methods described herein may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The foregoing is provided for purposes of illustrating, explaining, and describing embodiments of this disclosure. Modifications and adaptations to these embodiments will be apparent to those skilled in the art and may be made without departing from the scope or spirit of this disclosure.

As used herein and in the appended claims, the singular forms "a", "an", and "the" include plural referents unless the context clearly dictates otherwise.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic intervening entities) and the indirect coupling of two entities (with one or more non-negligible intervening entities). Where entities are shown as being directly coupled together or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described herein. A variety of modifications and variations are possible in light of the above teachings without departing from the following claims.

What is claimed is:

1. A ready-to-load ammunition container, comprising:

a housing comprising a first sidewall, a second sidewall, a top, and a bottom portion of the housing each defining an interior of the housing, the interior to retain a plurality of rounds;

a first wing integrally molded to the first sidewall and a second wing integrally molded to the second sidewall, the first wing and the second wing each positioned at the bottom portion of the housing, the first wing and the second wing to define an opening to allow the plurality of rounds to pass therethrough, and the first wing and the second wing to releasably engage with a magazine of a firearm; and a push bar connected to a sliding member to forcibly push the plurality of rounds through the opening, wherein the bottom portion of the housing includes a pull tab and is removably connected to the first wing and the second wing.

2. The ready-to-load ammunition container of claim 1, wherein the first sidewall and the second sidewall include one or more structural elements to provide rigidity to the housing.

3. The ready-to-load ammunition container of claim 1, wherein the push bar includes a first tab and a second tab, the first tab positioned on a left side and the second tab positioned on a right side, wherein each of the first tab and the second tab increase grip when sliding the push bar downwards.

4. The ready-to-load ammunition container of claim 3, further comprising a clip to selectively retain the push bar at a top portion of the housing.

5. The ready-to-load ammunition container of claim 1, wherein a front of the housing includes a first face and a second face, wherein the first face and the second face at least partially cover the front of the housing.

6. The ready-to-load ammunition container of claim 1, wherein the first wing and the second wing form a friction fit with a top of the magazine.

7. The ready-to-load ammunition container of claim 1, wherein housing is constructed of single-use disposable materials.

8. The ready-to-load ammunition container of claim 1, wherein the housing is constructed to be re-used by reloading the housing with an amount of ammunition.

9. A ready-to-load ammunition container, comprising:

a housing comprising a first sidewall, a second sidewall, a top, and a bottom each defining an interior of the housing, the interior to retain a plurality of rounds;

a first wing integrally molded to the first sidewall and a second wing integrally molded to the second sidewall, the first wing and the second wing each positioned at a bottom portion of the housing, the first wing and the second wing to define an opening to allow the plurality of rounds to pass therethrough, and the first wing and the second wing to releasably engage with a magazine of a firearm;

a push bar connected to a sliding member to forcibly push the plurality of rounds through the opening; and a pull tab provided on a front of the bottom of the housing, the pull tab to facilitate the removal of the bottom prior to reloading the magazine of the firearm, wherein the ready-to-load ammunition container provides efficient reloading of the magazine of the firearm.

10. The ready-to-load ammunition container of claim 9, wherein the bottom is removably connected to the first wing and the second wing.

11. The ready-to-load ammunition container of claim 10, wherein the first sidewall and the second sidewall include one or more structural elements to provide rigidity to the housing.

12. The ready-to-load ammunition container of claim 11, wherein the push bar includes a first tab and a second tab, the first tab positioned on a left side and the second tab positioned on a right side, wherein each of the first tab and the second tab increase grip when sliding the push bar downwards.

13. The ready-to-load ammunition container of claim 12, further comprising a clip to selectively retain the push bar at a top portion of the housing.

14. The ready-to-load ammunition container of claim 13, wherein a front of the housing includes a first face and a second face, wherein the first face and the second face at least partially cover the front of the housing.

15. The ready-to-load ammunition container of claim 14, wherein the first wing and the second wing form a friction fit with a top of the magazine.

16. The ready-to-load ammunition container of claim 15, wherein housing is constructed of single-use disposable materials.

17. The ready-to-load ammunition container of claim 16, wherein the housing is constructed to be re-used by reloading the housing with an amount of ammunition.

18. A ready-to-load ammunition container, comprising:

a disposable housing comprising a first sidewall, a second sidewall, a top, and a bottom each defining an interior of the housing, the interior to retain a plurality of rounds, the housing to provide a barrier to protect the plurality of rounds during shipping and storage;

one or more structural elements to provide rigidity to the first sidewall and the second sidewall;

a first wing integrally molded to the first sidewall and a second wing integrally molded to the second sidewall, the first wing and the second wing each positioned at a bottom portion of the housing, the first wing and the second wing to define an opening to allow the plurality of rounds to pass therethrough, and the first wing and the second wing to releasably engage with an upper portion of a magazine of a firearm;

a push bar connected to a sliding member to forcibly push the plurality of rounds through the opening, the push bar comprising a first tab and a second tab each forming a grip; and a pull tab provided on a front of the bottom of the housing, the pull tab to facilitate the removal of the bottom prior to reloading the magazine of the firearm, wherein the ready-to-load ammunition container provides efficient reloading of the magazine of the firearm.

* * * * *